US005429707A

United States Patent [19]

Smith

[11] Patent Number: 5,429,707

[45] Date of Patent: Jul. 4, 1995

[54] PROCESS AND APPARATUS FOR MANUFACTURING PANELS FOR PROTECTIVE GARMENTS

[75] Inventor: Raymond Smith, Ronkonkoma, N.Y.

[73] Assignee: Lakeland Industries, Inc., Ronkonkoma, N.Y.

[21] Appl. No.: 316,816

[22] Filed: Oct. 3, 1994

Related U.S. Application Data

[63] Continuation-in-part of Ser. No. 935,839, Aug. 27, 1992, abandoned.

[51] Int. Cl.[6] ..... B30B 5/00; B30B 15/34; B32B 31/18

[52] U.S. Cl. ..... 156/515; 156/251; 156/511; 156/518; 156/583.1; 156/583.4

[58] Field of Search ..... 156/515, 518, 553, 528, 156/530, 511, 251, 583.1, 583.3, 583.4; 2/81, 82, 243 B

[56] References Cited

U.S. PATENT DOCUMENTS

| | | | |
|---|---|---|---|
| 2,425,388 | 8/1947 | Oestricher | 156/515 |
| 2,796,913 | 6/1957 | Fener | 156/515 |
| 3,015,601 | 1/1962 | Fener | 156/515 |
| 3,198,685 | 8/1965 | Kopito | 156/251 |
| 3,253,122 | 5/1966 | Kochmer | 156/251 |
| 3,912,575 | 10/1975 | Zelnick | 156/515 |
| 4,137,114 | 1/1979 | Ours | 156/251 |
| 4,272,851 | 6/1981 | Goldstein | 2/82 |
| 4,861,413 | 8/1989 | Schmitz | 156/251 |
| 4,999,081 | 3/1991 | Buchanan | 156/251 |
| 5,082,721 | 1/1992 | Smith | 2/81 |

*Primary Examiner*—Michael W. Ball
*Assistant Examiner*—Daniel J. Stemmer
*Attorney, Agent, or Firm*—John Lezdey

[57] ABSTRACT

There is provided an improvement in a process and apparatus for preparing panels used in the manufacture of protective garments with compression platens. The platens are provided with at least one heating element which is tensioned by spring means and forms a pattern for a panel. Two panels may be formed simultaneously each having seamed leg and arm portions and are to be joined by heat sealing along the back.

6 Claims, 2 Drawing Sheets

PROCESS AND APPARATUS FOR MANUFACTURING PANELS FOR PROTECTIVE GARMENTS

RELATED APPLICATION

This application is a continuation-in-part of application Ser. No. 07-935,839, filed Aug. 27, 1992, now abandoned.

FIELD OF THE INVENTION

The present invention relates to a process and apparatus for manufacturing panels for protective garments in a manner to minimize waste and reducing or eliminating sewing. More particularly, there is provided an apparatus for cutting a pattern and heat sealing edges of the pattern to form panels for protective garment.

BACKGROUND OF THE INVENTION

Protective garments include woven and non-woven fabrics for disposable use. The garments are generally formed from polymeric or laminated materials which are intrinsically dust or liquid penetration resistant and in some cases resistant to chemical vapor penetration. The fabrics are generally spunbonded, meltspun or related non-woven thermoplastic material. The vapor or gas-tight suits must meet the permeation criterion of ASTM D-739-85 and the liquid barrier suits must meet the penetration criterion of ASTM F903-84. For example, the suits are evaluated by exposure to a liquid permeation test medium, such as a mixture comprising 4 weight percent polychlorinated biphenyl, 6 weight percent trichlorobenzene, and 90 weight percent mineral spirits, or other multicomponent or single component test medium which is applied to the seam area of a garment sample, and the breakthrough time to penetration is measured.

Also, the non-woven fibrous fabrics must stop the penetration of dust from reaching the clothing or skin of the person wearing the garment.

U.S. Pat. No. 4,272,851 to Goldstein, which is herewith incorporated by reference, discloses a protective garment for use in hazardous environments, the body of the garment being formed of a non-woven spun bonded olefin having a polyethylene film laminated to one side thereof. This garment utilizes bonded seams which are ultrasonically welded. A sewn binding is sewn externally of the bonded seam so that the welded seam is located between the stitching and the interior of the garment. The ultrasonic bonding requires close control and the bonding does not produce seams of satisfactory strength.

U.S. Pat. No. 5,082,721 to Smith et al, which is herewith incorporated by reference, discloses fabric for use in manufacturing protective garments that can be used in the present invention.

Sewn seams cause needle holes which provide penetration by dust or vapors through the holes or the seams themselves.

Bonded seams formed by hot melt adhesive joining methods are known in various applications, but have the disadvantage that they typically weaken the seam's supporting fabric by thermal degradation thereof during seam-forming operation so that the mechanical properties of the supporting fabric, e.g., its tensile strength, are detrimentally reduced.

SUMMARY OF THE INVENTION

The present invention provides an improvement in the manufacture of thermoplastic non-woven fabrics or web panels which are used in the manufacture of protective garments. According to the invention, a pair of thermoplastic polymeric sheets are passed through a pair of, platens which are juxtaposition (side-by-side) when the platens are contracted (compressed) i.e., in the closed position causing a scissoring effect. Note, the term "contracted" is used throughout the specification to signify that the platens are placed in the closed position. On one of the platens there is provided a heating element which forms a pattern for the protective garment. The heating element is tensioned with a spring means to overcome imperfections which can result by the expansion and contraction of the heating element during the process.

Preferably, insulation material is placed beneath the heating elements and a covering is placed over the heating elements to prevent adhesion to the polymeric sheets being cut and/or fused. There can also be provided a heat stable release film between the heating elements and the layers of fabric.

Advantageously, both platens have heating elements which are juxtapostioned (side-by-side) when the platens are contracted (compressed) causing a scissoring effect for use with polymeric sheets which do not readily flow when heated or where a dwell period and pressure are necessary to cause the molten polymer to flow to form a strong sealed seam.

The present invention further provides an improved process for the manufacture of non-woven thermoplastic web panels for use in manufacturing protective garments by simultaneously cutting a fabric pattern and fusion bonding the edges of a pair of panels which form the basic elements of a protective garment so as to provide a reduction or elimination of sewn seams.

It is therefore an objective of the invention to provide an improvement in an apparatus for simultaneously cutting and seaming panels for a protective garment.

It is a further object of the invention to provide a process for rapidly and economically preparing panels for a protective garments.

It is another object of the invention to provide a means for simultaneously cutting and seaming sheets of polymeric materials having a low melt index.

It is yet another object to provide a device for forming a seam for a laminate having different melt flow rates.

It is still another object to reduce or eliminate sewing required to form protective garments.

These and other objects of this invention will be more completely described and disclosed in the following description with reference to the accompanying drawings.

DESCRIPTION OF THE PREFERRED EMBODIMENTS

Although specific terms are used in the following description for the sake of clarity, these terms are intended to refer only to a particular structure or feature selected for illustration, and are not intended to define or limit the scope of the invention.

Figure 1:
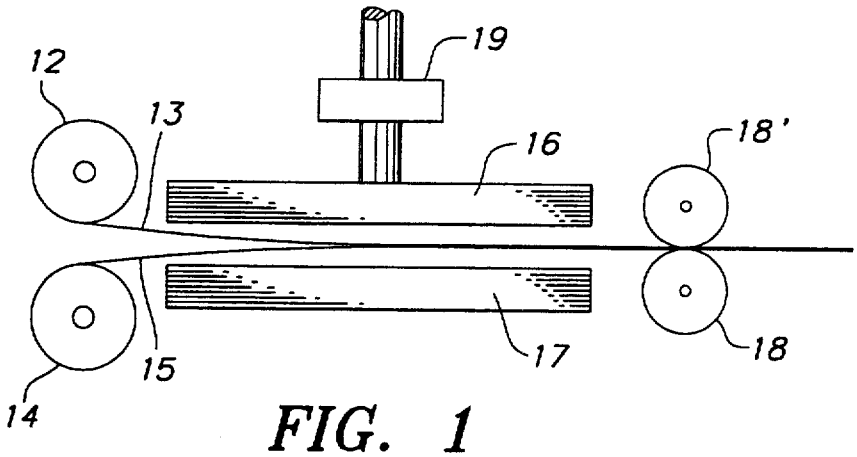
FIG. 1 is a side plan elevational view of the apparatus of the invention.

As illustrated in FIG. 1, the apparatus of the invention provides for the delivery of a pair of polymeric sheets 13, 15 from supply rolls 12, 14, respectively. The sheets 13, 15 travel between a pair of contracting platens 16, 17 and are removed with pinch rolls 18,18'. The time the sheets dwell between the platens and the synchronization of the supply rolls 12, 14 with the pinch rolls 18,18' is preferably accomplished by computer control means 19 in a known manner.

Figure 2:
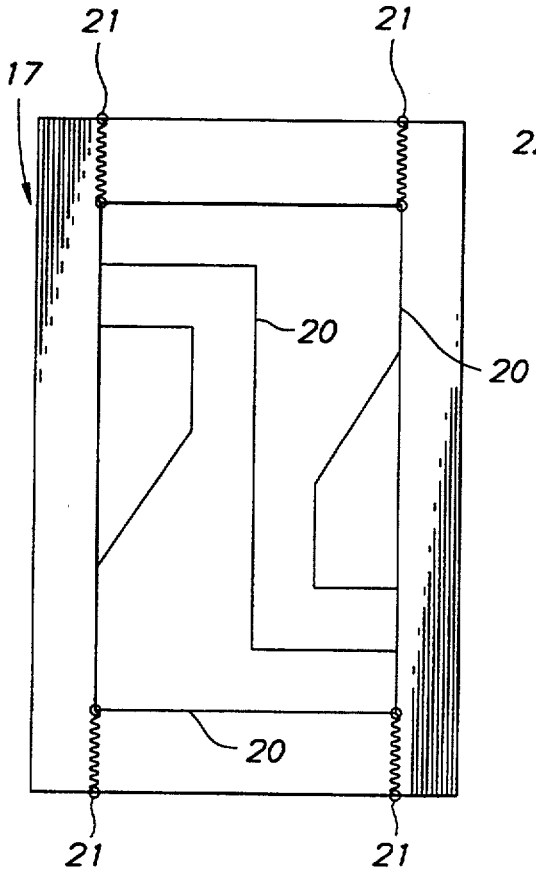
FIG. 2 is a top view of the bottom platen of FIG. 1 showing a pattern of the heating element.

As seen in FIG. 2, one of the platens, preferably the bottom platen 17, is provided with a heating element 20 which is in a configuration for forming two halves for a protective garment. When the polymeric sheets 13, 15 are between the platens 16,17, the upper platen 16, which is generally the contracting platen, is activated by computer means 19 to put the sheets 13,15 onto the heating element 20 on the lower platen 17. The heating element is simultaneously activated to heat for a period of time depending upon the polymeric material, to cause the polymeric material to flow, fuse to a continuous film in the area of the seam and bond while simultaneously thinning the area so that the material will tear apart at the seams as if cut. After the heating period there is a dwell time when the heat is stopped. The dwell time varies with each type of polymeric material.

Figure 3:
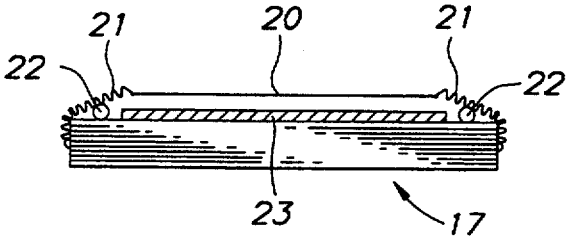
FIG. 3 is a front elevational view of the platen of FIG. 2.

As more clearly illustrated in FIG. 3, the heating element 20 is tensioned with a spring means 21. The spring means 21 is critical in a process for mass producing the panels for the protective garments because the heating element 20 constantly undergoes expansion and shrinking as it heats and cools. Preferably, the heating element 20 is tensioned over an inert riser 22 comprising an insulated porcelain or metal bar which is covered with a material which can transfer heat and prevent sticking, for example, a TEFLON and/or fiberglass tape.

The heating element 20 is preferably in the form of a band or a wire. The wire or band can be copper, chromium, steel, and the like, but is most preferably nichrome. A circular wire or thin flat metal band heating element is preferred for most thermoplastic non-woven fibrous sheets. The treated wire is preferred as a cutting device.

Figure 4:
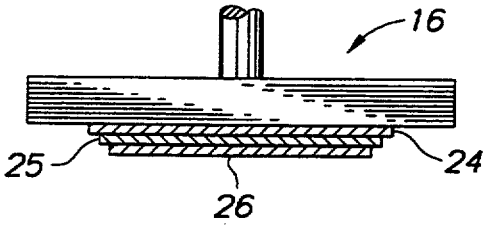
FIG. 4 is front elevation view of the top platen of FIG. 1.

In cases where the polymeric sheet material 13, 15 comprises a polymer having a low melt index such as TYVEK ®, a spun bonded polyethylene, or a laminate of different polymers or films, it is preferable that the other platen 17 be provided with a heating element 26 as illustrated in FIG. 4. The heating element 26 should be arranged so as to be juxtapostioned (side-by-side) with the other heating element 20 when the platens 16, 17 are contracted so as to provide a scissoring effect.

The advantages of having heating elements on both the platens is found when the sheet material comprises TYVEK or is a laminate of polymeric materials having different melt flow indices. The separate heating of the two elements 20, 26 will permit the heating to cause one of the polymers to flow while the other polymer is softened so that slight platen contraction or compression will cause a bead seam of greater strength.

A heating element 26 which is a band of about $\frac{1}{4}$ to $\frac{1}{2}$" is preferably for use with polymeric materials with a low melt index since the materials do not form a flow which can form a suitable seam. Preferably the heating element 26 is separately controlled as to temperature from heating element 20.

The heating element 26 need not be tensioned as required by heating element 20. It is suitable to support the heating element by a resilient elastomeric material 24 which is covered with an insulation 25.

Figure 5:
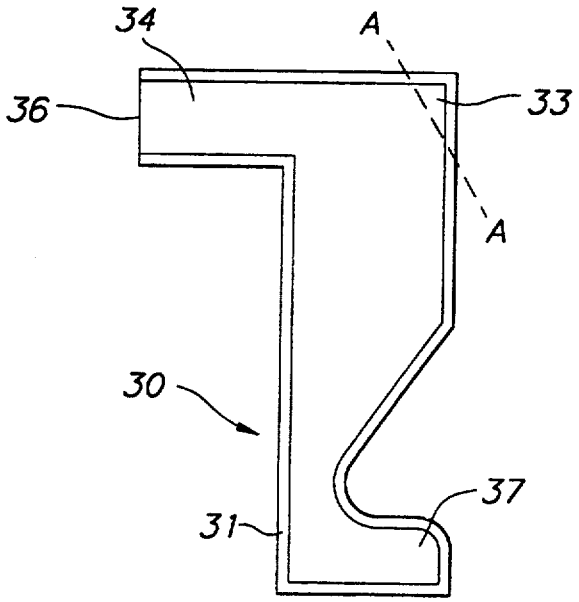
FIG. 5 is a front view of the left half of the garment prepared by the apparatus of the invention.

The configuration of the heating element 20 is particularly important in the present invention to provide a web panel 30 which does not have any substantial waste material and can be easily transformed into an outer garment. FIG. 5 shows a panel 30 which is one half of the protective garment prepared by the apparatus of the invention. Another one-half of the garment which is similar to panel 30 but forms the second half of the garment simultaneously and adjacent to panel 30. The panel 30 is formed with a seamed arm portion 36 and an opening 33 which is seamed with the other half 35 to form the garment of FIG. 6.

The neck portion 40 of the garment 41 is made by cutting each half of the panel along line A—A.

To complete the garment, elastic bands or gathers are added at the end of the arm portions and a zipper is bonded to the garment at the opening 32.

The web panels used in the invention may comprise a polymeric material which is a single layer or multi-layered construction, as desired. They are generally thermoplastic non-woven fabrics such as spunbonded polyester, meltspun polyester, hydroentangled polyester, and the like. Illustrative of the polymeric material are polyolefins such as polyethylene, polypropylene, other polymers derived from ethylenically unsaturated monomers including vinyl alcohol, vinyl chloride, vinylidene chloride, and the like. In addition, polyesters, nylon or mixed fibrous webs may be used. Most preferred are web panels comprising TYVEK ®, a spunbonded non-woven polyethylene web (E. I. DuPont de Nemours & Company, Inc. Wilmington, Del.).

Alternatively, the web panels or garments of the present invention may be of laminated form, comprising a plurality of associated layers of materials such as those previously described in respect of mono-layer panels. In such laminates, the respective layers may be coextruded or otherwise conformed, or those layers may be joined to one another subsequent to their initial formation, as for example by elevated temperature interpenetration, chemical reactions between functional groups on opposing faces in the laminate, etc. A particularly preferred laminate for the present invention comprises TYVEK ® laminated or coated with one or more layers of polyethylene homopolymer, ethylene/vinyl acetate copolymer, ethylene/vinyl alcohol copolymer and vinylidene chloride/vinyl chloride copolymer.

Liquid penetration resistant tapes may be placed over the seams to provide additional strength and to prevent pin-holes at the seams. The tape may be formed similarly of any suitable material which is satisfactory to provide the desired liquid penetration to the seam assembly. The tape is suitably a mono-layer or a laminate material formed of materials such as polyolefins, polymers derived from other ethylenically unsaturated monomers, laminates thereof, etc.

Figure 6:
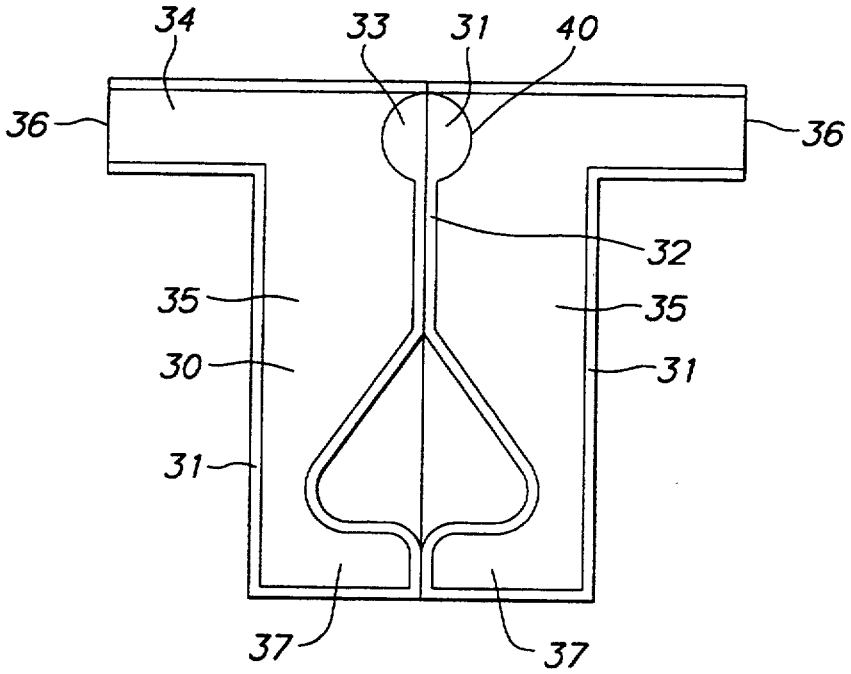
FIG. 6 is a front view of the two panels seamed.

More generally, the tape closure may be affixed to the second side of the adjacently adjoined panels shown in FIG. 6 in any suitable manner such as by elevated temperature interpenetration, chemical bonding, adhesive bonding, etc.

In the neck region of the garment, the body portion may be joined to a hood (not shown). The hood has a frontal piece of suitable transparent material such as MYLAR ®, polycarbonate, etc.

A particular advantage of the invention is achieved when the heating elements on the platens are configured to form two panels having an arm portion and a leg portion formed and seamed and the back portion of the garment being the location for the joining seam between the panels. The design advantage is seen in FIG. 3 where the panels to be formed are each adjacent the sides and their leg and arm portions are each adjacent an arm and leg portion of the other panel, respectively.

Accordingly, there is provided a method for preparing a pair of web panels having leg, arm and side portions for use in the manufacture of protective garments. The method comprises forming a pattern with heating means on each of a pair of contraction or compression platens. Configuring the pattern so as to form two panels on plastic sheets having an arm portion and a leg portion of one panel adjacent a leg portion and an arm portion respectively of the other panel. The heating elements on each of the platens are positioned so as to be juxtapositioned (side-by-side) when the platens are contracted so as to provide a scissoring effect. Plastic sheets are passed between the platens and the platens are contracted. Upon contraction, the platens are in a closed position and the heating means on each platen is activated so that the heating temperature of one of the heating means is higher than the temperature of the other heating means to cause one of the polymeric sheets to flow and create a seam. The panels are then seamed and thinned so as to easily obtain a pair of panels forming one half of a protective garment.

A dwell period for heating and contraction is about generally about 5 to 15 seconds depending upon the materials utilized and their thickness.

While preferred embodiments of the invention have been described in detail, it will be appreciated that other variations, modifications, and embodiments are possible, and accordingly all such variations, modifications, and embodiments are to be regarded as being within the spirit and scope of the invention.

What is claimed is:

1. In an apparatus for forming a pair of web panels for use in preparing protective garments from sheets of polymeric materials, said apparatus having a pair of platens which have an open and closed position, wherein the improvement comprises: one platen having a first heating element comprising a wire in a pattern to form two halves of a protective garment, each half having a seamed leg and arm portion, spring means tensioning said first heating element, and the other platen having a second heating element comprising a band which is adjacent to said first heating element so as to be in a side-by-side relationship causing a scissoring effect when the platens are in the closed position, said pattern configured to form first and second adjacent panels, each panel having a leg portion and an arm portion with the leg portion of the first panel being adjacent to the arm portion of the second panel and the arm portion of the first panel being adjacent to the leg portion of the second panel, and heating means on each platen for separately heating said first and second heating elements at different temperatures so as to cut and fuse the polymeric material when the platens are placed in the closed position.

2. The apparatus of claim 1 wherein said heating element comprises a metallic wire.

3. The apparatus of claim 1 wherein said heating element comprises a metallic band.

4. The apparatus of claim 1 including means for feeding sheets of polymeric materials between said platens.

5. The apparatus of claim 1 wherein said first heating element is coated with a halogenated hydrocarbon.

6. In an apparatus for forming web panels for use in preparing protective garments from sheets of polymeric material, said apparatus having a pair of platens which have an open and closed position, wherein the improvement comprises: said platens have on each surface that comes in contact with said sheets, at least one heating element forming a pattern for said element on each of said platens, said pattern configured to form first and second adjacent panels, each panel having a leg portion and an arm portion with the leg portion of the first panel being adjacent to the arm portion of the second panel and the arm portion of the first panel being adjacent to the leg portion of the second panel, said heating elements on each of the platens are positioned so as to be in a side-by-side relationship causing a scissoring effect when the platens are in the closed position, and heating means on each platen for separately heating said heating elements to different temperatures so as to cut and fuse the polymeric material when the platens are placed in the closed position.

* * * * *